US007544082B1

(12) United States Patent
Halvorsen

(10) Patent No.: US 7,544,082 B1
(45) Date of Patent: Jun. 9, 2009

(54) ELECTRICAL CONNECTION GUARD

(76) Inventor: Leif Halvorsen, 8 Market Place Ct., Palm Coast, FL (US) 32137

( * ) Notice: Subject to any disclaimer, the term of this patent is extended or adjusted under 35 U.S.C. 154(b) by 0 days.

(21) Appl. No.: 11/861,394

(22) Filed: Sep. 26, 2007

(51) Int. Cl.
*H01R 13/62* (2006.01)

(52) U.S. Cl. ..... 439/367; 174/135

(58) Field of Classification Search ..... 439/369, 439/367, 455, 456, 457, 449, 450; 174/6, 174/7, 135; 362/431
See application file for complete search history.

(56) References Cited

U.S. PATENT DOCUMENTS

| | | | | | |
|---|---|---|---|---|---|
| 4,131,122 | A | | 12/1978 | Brooks | |
| 4,953,067 | A | * | 8/1990 | Moore | 362/431 |
| 4,984,685 | A | | 1/1991 | Douglas | |
| 5,062,028 | A | * | 10/1991 | Frost et al. | 362/183 |
| 5,386,356 | A | * | 1/1995 | Davis et al. | 362/267 |
| 5,436,817 | A | | 7/1995 | Wotton et al. | |
| 5,504,397 | A | * | 4/1996 | Chien | 315/185 S |
| 5,655,829 | A | * | 8/1997 | Lin et al. | 362/145 |
| 5,692,828 | A | * | 12/1997 | Chung | 362/431 |
| 5,834,690 | A | | 11/1998 | Bastiaansen | |
| 5,848,838 | A | * | 12/1998 | Presta | 362/249 |
| 5,879,184 | A | | 3/1999 | Lopez | |
| 6,135,623 | A | * | 10/2000 | Lin | 362/431 |
| 6,300,570 | B1 | * | 10/2001 | Lai | 174/67 |
| D460,415 | S | | 7/2002 | Stekelenburg | |
| 6,805,581 | B2 | | 10/2004 | Love | |
| 7,041,899 | B2 | * | 5/2006 | Stekelenburg | 174/50 |
| 7,246,929 | B2 | * | 7/2007 | Schuster | 362/431 |
| 2004/0232276 | A1 | | 11/2004 | Ferris | |

* cited by examiner

*Primary Examiner*—T C Patel
*Assistant Examiner*—Harshad C Patel
(74) *Attorney, Agent, or Firm*—Christine Q. McLeod; Beusse, Wolter, Sanks, Mora & Maire, PA

(57) ABSTRACT

The present invention provides new weatherproof outdoor electrical connection guard for protecting electrical extension cord plug connections, especially in wet environments. The guard includes a protective housing for covering the point of connection between an extension cord plug and the mating plug from a power-consuming device inserted therein. A catch is provided to removably secure the connected cords within the housing. An elongated stake is provided for securing the connection guard in an elevated position above the ground. The connection guard further includes ventilation for moisture and heat dissipation.

19 Claims, 6 Drawing Sheets

ELECTRICAL CONNECTION GUARD

FIELD OF INVENTION

This invention relates to electrical connection guards and more particularly pertains to a new weatherproof outdoor electrical connection guard for protecting electrical extension cord plug connections, especially in wet environments.

BACKGROUND OF INVENTION

Electrical extension cords, generally defined as any detached/portable 110-volt or higher voltage wiring that is used to transfer power from an outlet or power source to a power consuming device, are designed to provide temporary power to a tool or equipment when a conventional outlet is not nearby. Typically an extension cord has one male plug on one end and one to three receptacles on the other end. With the wide use of portable tools on construction sites, the use of extension cords often becomes necessary.

Unfortunately, hazards are created when extension cords are improperly used and maintained. The U.S. Consumer Product Safety Commission (CPSO) estimates that each year, about 4,000 injuries associated with electric extension cords are treated in hospital emergency rooms. A large number of the injuries are from electric shock. For example, if the electrical conductors become exposed, there is a danger of shocks, burns, or fire. A frequent hazard on a construction site is at the plug connection point with improperly connected terminals. When the plug connection point is wet (e.g., resting in a puddle), hazardous leakage can occur to the equipment-grounding conductor and to humans who pick up the cord at the plug connection point if they also provide a path to ground. Therefore, it is good practice to limit exposure of connectors and tools to excessive moisture and to keep plugs above ground in wet environments to reduce the chance of electrical shock.

In addition to electric shock, about half the injuries associated with electric extension cords involve fractures, lacerations, contusions, or sprains from people tripping over extension cords.

Several devices have been proposed and patented which address outdoor electrical connectors, extension cords, and covers, including U.S. Pat. Nos. 4,131,122, 4,984,685, 5,436,817, 5,834,690, 5,879,184, 6,300,570, 6,805,581, D460415, and U.S. Patent Application Pub. No. 20040232276. While these devices may be suitable for the particular purpose to which they address, they would not be as suitable for the purposes of the present invention as heretofore described.

SUMMARY OF INVENTION

The present invention provides new weatherproof outdoor electrical connection guard for protecting electrical extension cord plug connections, especially in wet environments. The guard includes a protective housing for covering the point of connection between an extension cord plug and the mating plug from a power-consuming device or another extension cord inserted therein. A catch is provided to removably secure the connected cords within the housing. An elongated stake is provided for securing the connection guard in an elevated position above the ground or similar soft surface. Alternately, a mount is provided for securing the connection guard in an elevated position above a driveway, deck, sidewalk, or similar hard surface. The connection guard further includes ventilation at or near the cap for moisture and heat dissipation.

In an embodiment, the invention comprises a weatherproof electrical connection guard for protecting electrical cord plug connections, comprising: (1) an elongated vertical housing having a closed top for providing protection from the weather and an open bottom for access to an interior compartment within the housing; the interior compartment adapted to receive through the open bottom an interconnected first plug and second plug of a pair of electrical cords; (2) a catch proximal to the open bottom adapted to releasably secure the pair of electrical cords to prevent disconnection of the interconnected first plug and second plug when a pulling force is applied to either of said pair of electrical cords; and (3) a mount extending from the elongated vertical housing for vertically mounting the connection guard in an elevated position above a surface. The connection guard may further include a strap proximal to the open bottom adapted to releasably secure the pair of electrical extension cords to the connection guard. The closed top may further include ventilation holes for moisture and heat dissipation. The closed top may be arcuate and/or removable. The catch is made up of a slotted member sized to securely retain the pair of electrical extension cords.

The mount may be an elongated spike for insertion into a soft surface to maintain the connection guard in an elevated vertical position above the surface. The elongated spike may be telescoping to allow for differing elevations above the surface. In an alternate embodiment, the mount comprises a flush ground mount comprising a base with a generally flat bottom adapted to be disposed on the surface of hard ground. The invention may further include a hook attached near the top of the connection guard for vertically hanging the connection guard in an elevated position.

For safety, the weatherproof electrical connection guard may include a highly visible coating, such as bright paint, fluorescent paint or reflective coatings/markers to alert users of its location. An audible alarm or visible alarm may be provided to alert users of its location for safety.

Additional features may include a viewing window in the housing for viewing the interconnected plugs and/or an access door in the housing for providing access to the interconnected plugs. A moisture sensor may be provided within the interior compartment along with an alarm activated by the moisture sensor.

A primary object of the present invention is to provide an outdoor electrical connection guard that will overcome the shortcomings of the prior art devices.

Another object is to provide an outdoor electrical connection guard that is waterproof and weatherproof, which will safely connect an extension cord plug to a power-consuming device.

An additional object is to provide outdoor electrical connection guard having a protective housing that is elevated from the ground, for stability and elevation from the ground, especially in wet environments.

A further object is to provide an outdoor electrical connection guard that is highly visible to deter people from accidentally coming in contact with the connection point or tripping over it.

A further object is to provide an outdoor electrical connection guard that helps prevent the power-consuming device from inadvertently disconnecting from the extension cord.

A further object is to provide an outdoor electrical connection guard that is simple and easy to use.

A still further object is to provide an outdoor electrical outlet protector that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims. Additional objects, features and advantages of the invention will become more readily apparent from the following detailed description of a preferred embodiment thereof, when taken in conjunction with the drawings.

All patents, patent applications, provisional applications, and publications referred to or cited herein, or from which a claim for benefit of priority has been made, are incorporated herein by reference in their entirety to the extent they are not inconsistent with the explicit teachings of this specification.

BRIEF DESCRIPTION OF THE DRAWINGS

Further objects, features and advantages of the invention will become apparent from the following detailed description taken in conjunction with the accompanying figures showing a preferred embodiment of the invention, in which.

Figure 1:
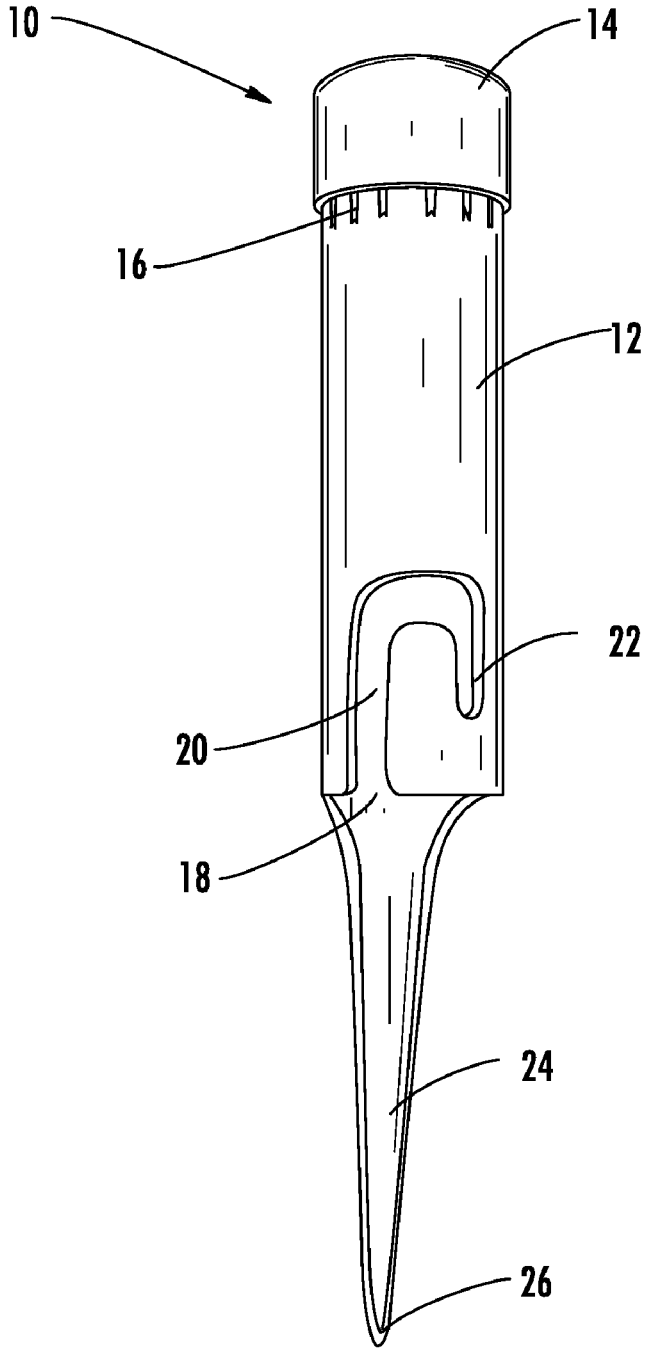
FIG. 1 is a front perspective view of the outdoor electrical connection guard in accordance with this invention.

Throughout the figures, the same reference numerals and characters, unless otherwise stated, are used to denote like features, elements, components or portions of the illustrated embodiment. Moreover, while the subject invention will now be described in detail with reference to the figures, it is done so in connection with a preferred embodiment. It is intended that changes and modifications can be made to the described embodiment without departing from the true scope and spirit of the subject invention.

DETAILED DESCRIPTION

Figure 2:
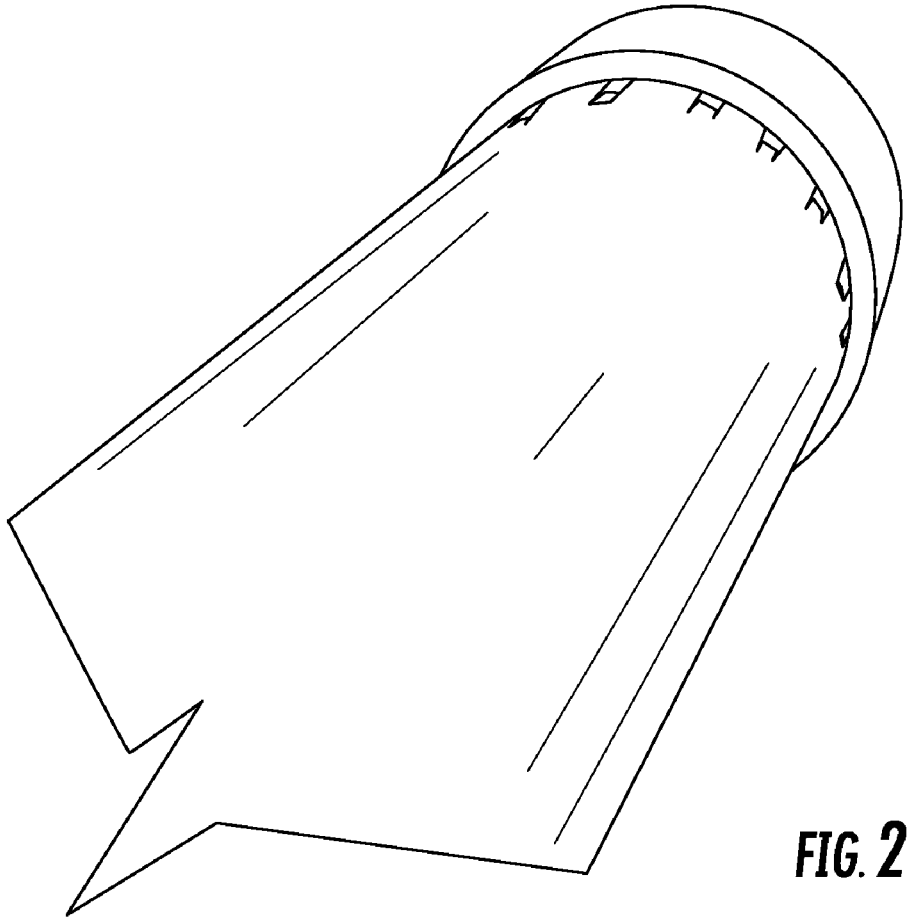
FIG. 2 is a perspective view of the top of the outdoor electrical connection guard in accordance with this invention.
Figure 3:
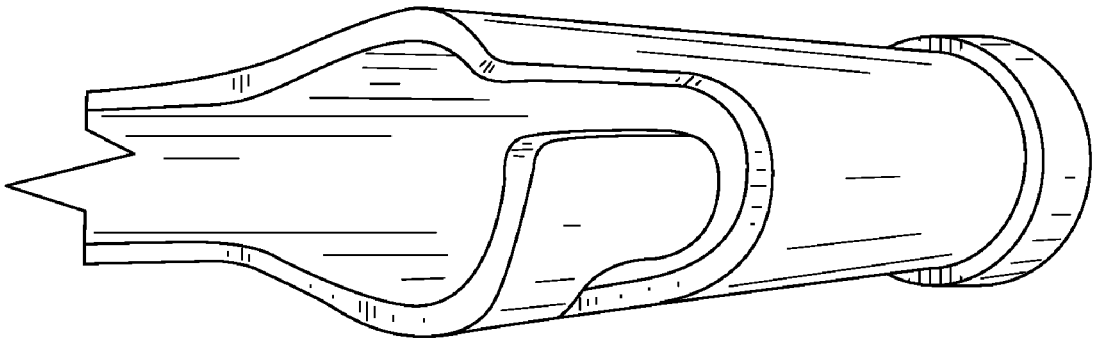
FIG. 3 is a perspective view of the bottom open end of the outdoor electrical connection guard in accordance with this invention.
Figure 4A:
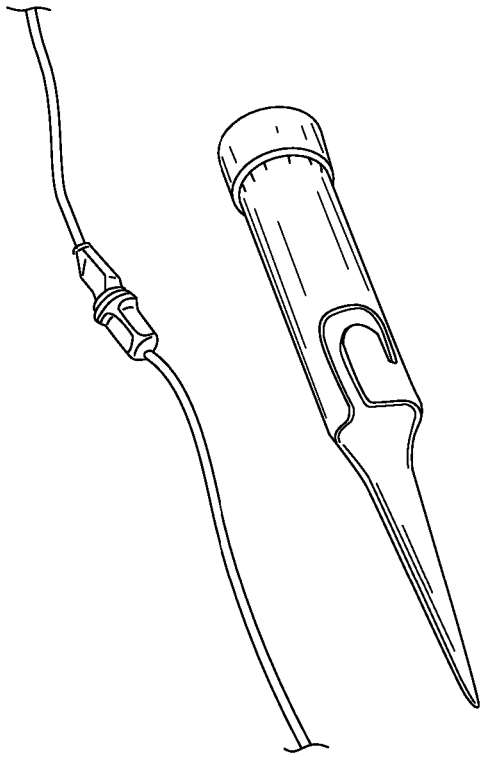
FIGS. 4*a*-4*e* illustrate use of the outdoor electrical connection guard in accordance with this invention.
Figure 4B:
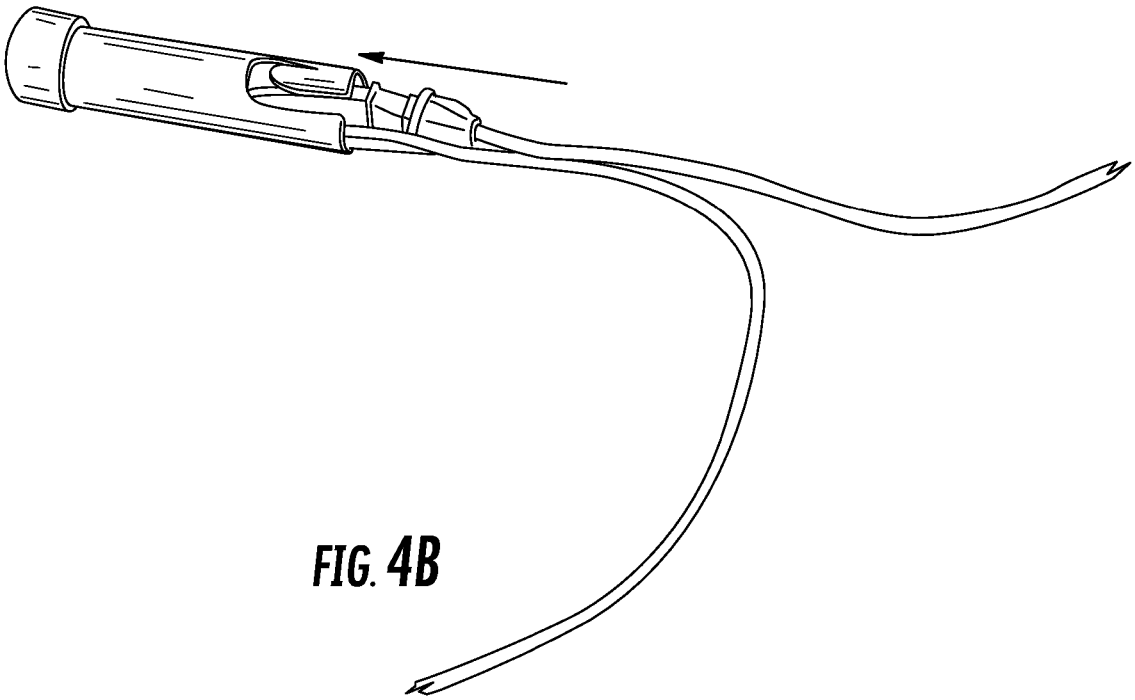
Figure 4C:
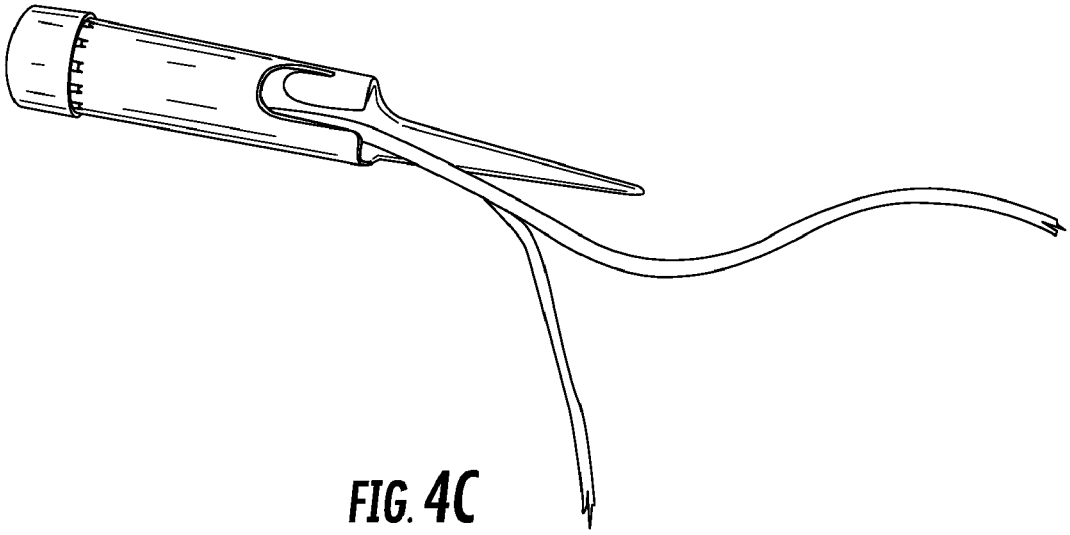
Figure 4D:
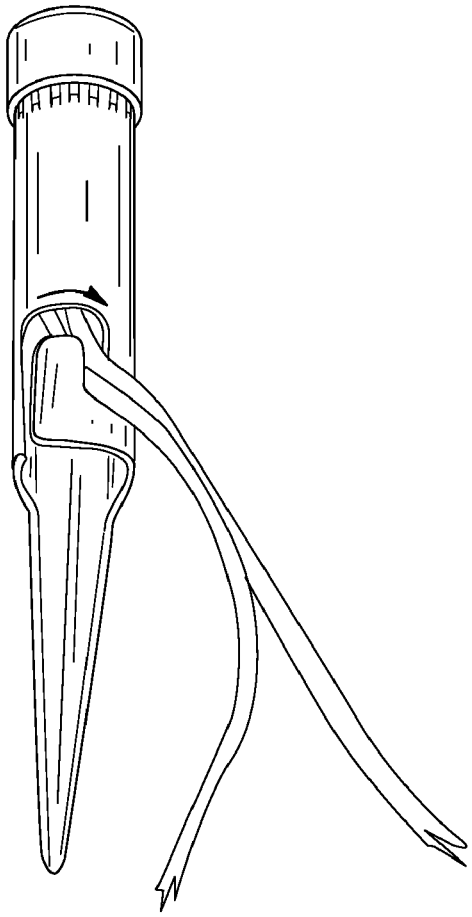
Figure 4E:
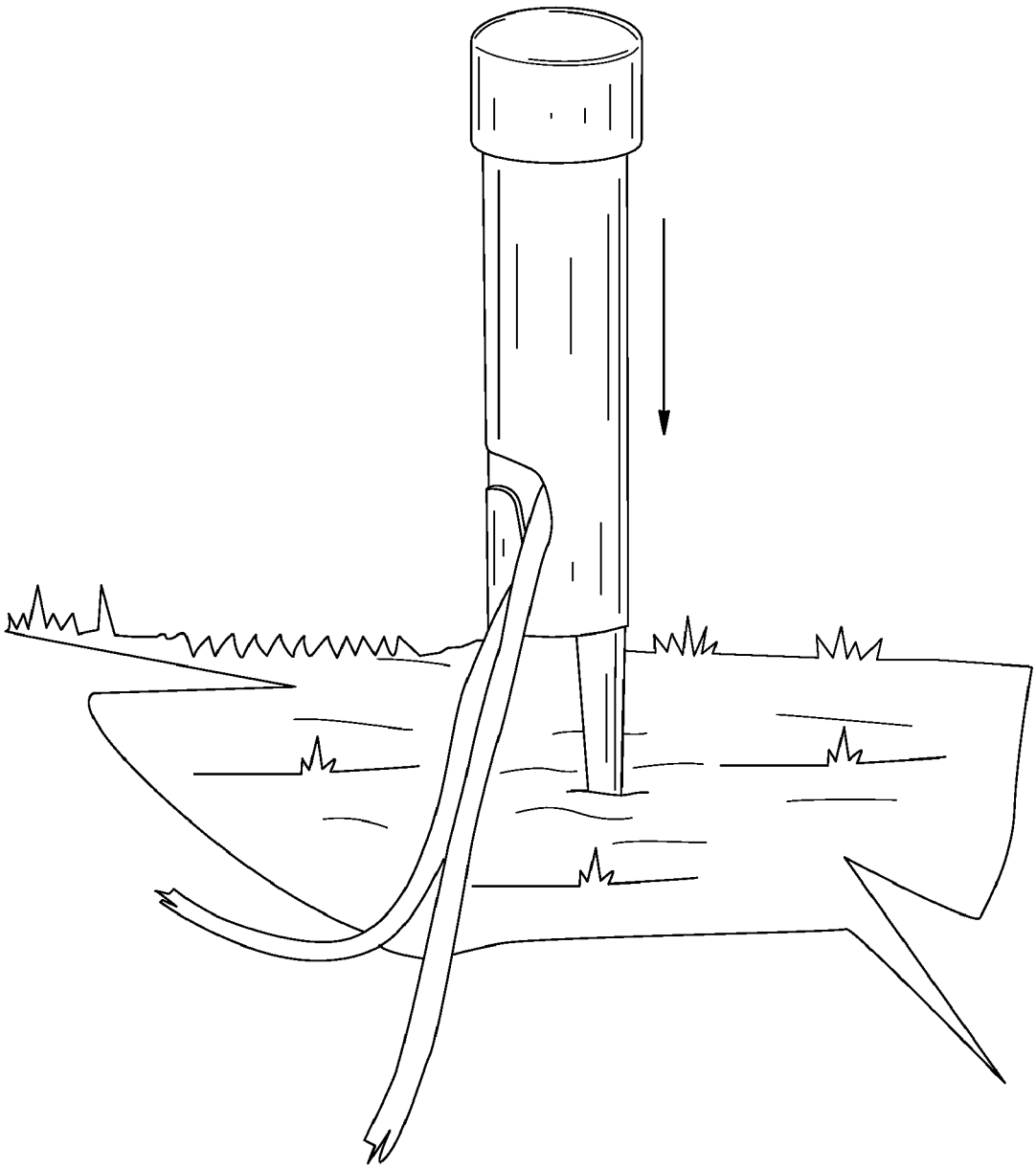
Figure 5:
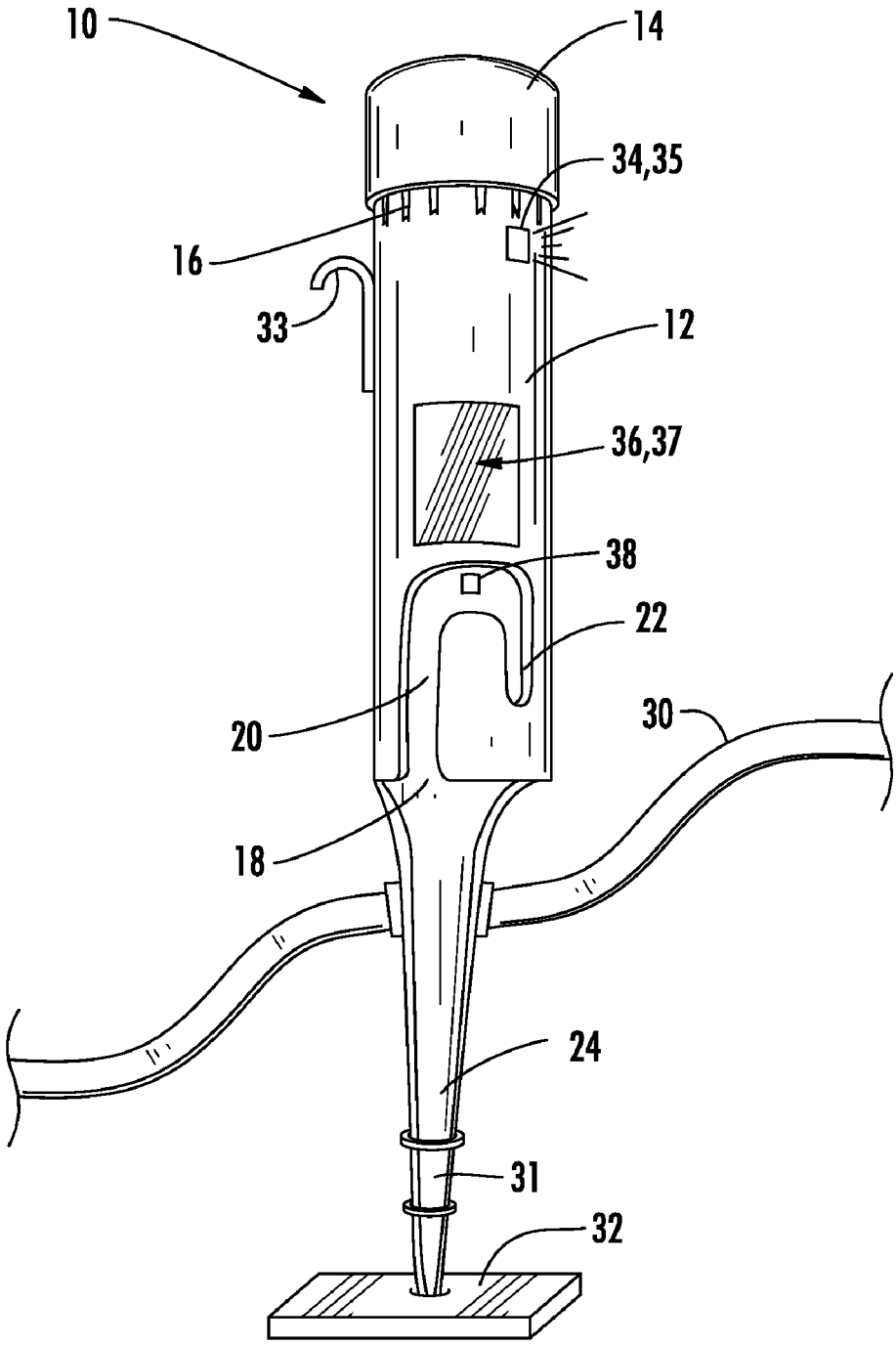
FIG. 5 illustrates certain additional features of the electrical connection guard in accordance with embodiments of this invention, including a strap 30, a telescoping spike 31, a flush ground mount 32, a hook 33, an audible alarm 34, a visible alarm 35, a window 36, a door 37, and a moisture sensor and alarm, collectively 38.

Referring to FIGS. 1-3, there is shown therein an outdoor electrical connection guard 10 according to one embodiment of the present invention. The outdoor electrical connection guard 10 includes a protective housing 12 comprising a vertical elongated member (tubular or other shape sufficient to maintain therein the extension cord plug and the mating plug from a power-consuming device or another extension cord) having a covered upper end 14, such as with a cap, and an open lower end 18. The protective housing 12 has an inner volume for containing and maintaining the plugs. The length and diameter of the protective housing 12 can vary. The preferred length is about 8 inches to about 12 inches. The preferred diameter is about 2-3 inches. The connection guard 10 is mounted vertically (as described in more detail herein) to provide weatherproof covering for the connected plugs off the ground, visibility for safety, and secured placement in a desired location.

Upper end 14 preferably further includes ventilation 16 at or near the cap for moisture and heat dissipation. Ventilation may comprise a plurality of slots beneath the cap or other suitable ventilation means. The cap may be removable.

Open lower end 18 allows easy insertion of the extension cord plug and the connected mating plug from a power-consuming device up into the protective housing. Open lower end 18 preferably also comprises a slot 20 for channeling the cords into a catch 22. Catch 22 helps securely maintain the connected cords within the housing and also prevents unintentional disconnection thereof. Alternate or additional means for securing the cords in place may be utilized as known in the art. For example, a strap (not shown), such as a Velcro® strap, buckle, tie wrap, or the like as known in the art, may be used to secure the cords around the elongated stake 24.

For vertical soft ground installation, an elongated stake 24 extends down from the protective housing 12 to secure the connection guard in an elevated position above the ground. A point or spiked tip 26 may be included for insertion into soft earth thus affixing the connection guard 10 to the ground. For ease of setting the connection guard in its environment of use, preferably the stake portion 24 is tapered. The stake 24 is inserted into the ground to retain the connection guard in place. The length of the stake 24 can vary. The preferred range is about 5 inches to about 12 inches. Alternate means for securing the connection guard in an elevated position above the ground may be utilized as known in the art, for example, a riser pipe or ground spike. The stake 24 may be telescoping.

For vertical hard ground installation, a ground mount (not shown) is provided for securing the connection guard in an elevated position above a driveway, deck, sidewalk, or similar hard surface. For example, a flush ground mount is provided that includes a base with a generally flat bottom adapted to be disposed on the surface of hard ground or on any appropriate relatively flat surface, such as a driveway, sidewalk, deck, etc., such as the flush mount shown in FIG. 4 of U.S. Pat. No. 6,386,729, incorporated herein by reference. Flush mount may further include additional securing means, such as screw holes for securing to the hard surface with screws, nails, etc. Alternately, a weighted ground mount may be used to retain the connection guard upright, wherein the ground mount would be heavy, letting the connection guard stand on the ground stably enough to not fall down. An extending flange (circular, square, etc.) formed around the ground mount may be provided to further stabilize the mount on a hard surface. The ground mount may be incorporated into the connection guard or may be a separate piece designed to receive the connection guard by means known in the art.

As an alternate installation technique, a hook (not shown) may be provided at or near the top of the connection guard for vertically hanging the connection guard in an elevated position, such as on a fence railing. The hook may be similar to that used for a droplight, as known in the art. It may be hook shaped or releasably lockable like a carabineer. The hook may further include an extendable strap to vary the height from which the guard is hung. The hook further provides a means for storing the connection guard, by allowing it to be hung up when finished using it.

Advantageously, by securely mounting the connection guard 10 in a desired location, the point of connection of the plugs may be easily found, especially if the connection needs to be periodically detached or quickly broken in case of an emergency. Without maintaining a fixed location for the connection, during use, the cords may pull the connection under a vehicle, into a puddle, or into another undesirable or inaccessible location, leading to unsafe conditions or wasted time looking for where the two cords are connected. The vertical positioning of the mount is also advantageous as it is less likely to be driven over, stepped on, or the like.

In accordance with the invention, the connection guard 10 may be constructed of PVC pipe with a cap 14, manufactured to include the elements of the invention. Alternatively, it may be of one-piece construction. It is preferred that the device be weatherproof to keep the connection dry. The cap 14 is preferably arcuate, although other shapes are contemplated herein. While it is preferred that the connection guard be fabricated relatively inexpensively from a rigid, high-strength, molded thermoplastic or PVC material, it will be appreciated that other suitable materials may be used instead.

The protective housing 12 has an inner volume for containing and maintaining the connected plugs. The length and diameter and shape of the protective housing 12 can vary. The housing 12 may be tubular, rectangle, or any suitable shape for receiving connected plugs. The housing 12 may be oversized for use with multiple-outlet extension cords, allowing for multiple connected plugs therein. The housing 12 may further include a transparent or translucent window for viewing inside the connection guard. The housing 12 may further include an accessible side door for interior access (for example, to check on the connection of the plugs without removing them from the housing 12.).

In order to provide additional safety measures, it is preferred that the device be highly visible. Bright coloring, such as orange, may be used. Reflective or fluorescent materials may also be used to improve their visibility. Moreover, additional caution markings may be included on or near the device. Other audible, visual, mechanical or other sensory signals may be applied onto the device as known in the art to increase visibility and awareness. These safety measures increase the visibility and making the presence and position visible and/or perceptible by others, especially by vehicular traffic when used on or near vehicular traffic throughways.

A moisture sensor (not shown) may be provided in the housing, as known in the art. The moisture sensor may be constructed using simple electronics, modular electrical components, and programmable microcontrollers. For example an impedance sensor typically constructed using thin and thick film techniques can be used. Operation of the sensor depends upon the adsorption of water into a porous non-conducting "sandwich" between two conductive layers built on top of a base ceramic substrate. The moisture sensor may further include an alarm output.

Turning now to FIGS. 4*a*-4*e*, to use the preferred embodiment of the connection guard 10, after the power-consuming device is plugged into the extension cord, the connected plugs are inserted up into the protective housing 12 through the open end 18 with the respective cords extending out of the open end 18. To maintain the plugs up within the housing 12, the cords are channeled through slot 20 into catch 22. The connection guard 10 is then inserted into the ground in an elevated position with the elongated stake 24, the flush mount, or hung with the hook. Alternately, the connection guard may be mounted first and then the plugs inserted up into the housing 12. A strap may be used to further secure the cords.

It will become apparent to those skilled in the art that many changes, modifications, variations, and other uses and application of the subject invention are possible and contemplated. The use of such terms as upper, lower, and the like are intended to be descriptive of the structure as it may be oriented in use, and is not intended to be restrictive in the claims to that orientation. It should be understood that the invention has application far beyond the exemplary embodiments presented and described herein, and as such is not to be limited to those embodiments. In addition, the invention is not limited to the particularly physical configuration, but instead is adaptable. All changes, modifications, variations, and other uses and applications which do not depart from the spirit and scope of the invention are deemed to be covered by the invention.

The invention claimed is:

1. A weatherproof electrical connection guard for protecting electrical cord plug connections, comprising:

an elongated vertical housing having a closed top for providing protection from the weather and an open bottom for access to an interior compartment within the housing; the interior compartment adapted to receive through the open bottom an interconnected first plug and second plug of a pair of electrical cords;

a slot in the open bottom comprising a catch sized to releasably secure the pair of electrical extension cords and to prevent disconnection of the interconnected first plug and second plug when a pulling force is applied to either of said pair of electrical cords; and a mount extending from the open bottom for vertically mounting the connection guard in an elevated position above a surface.

2. The weatherproof electrical connection guard of claim 1 further comprising a strap proximal to the open bottom adapted to releasably secure the pair of electrical extension cords to the connection guard.

3. The weatherproof electrical connection guard of claim 1 wherein the closed top further comprises ventilation holes for moisture and heat dissipation.

4. The weatherproof electrical connection guard of claim 1 wherein the closed top is arcuate.

5. The weatherproof electrical connection guard of claim 1 wherein the closed top is removable.

6. The weatherproof electrical connection guard of claim 1 wherein the mount comprises an elongated spike for insertion into a soft surface to maintain the connection guard in an elevated vertical position above the surface, the spike positioned on the side of the open bottom so as to not obstruct access to the interior compartment through the open bottom.

7. The weatherproof electrical connection guard of claim 6 wherein the elongated spike is telescoping to allow for differing elevations above the surface.

8. The weatherproof electrical connection guard of claim 1 wherein the mount comprises a flush ground mount comprising a base with a generally flat bottom adapted to be disposed on the surface of hard ground, the mount connected to the side of the open bottom so as to not obstruct access to the interior compartment through the open bottom.

9. The weatherproof electrical connection guard of claim 1 further comprising a hook attached near the top of the connection guard for vertically hanging the connection guard in an elevated position.

10. The weatherproof electrical connection guard of claim 1 further comprising a highly visible coating to alert users of its location for safety.

11. The weatherproof electrical connection guard of claim 10 wherein the visible coating is reflective.

12. The weatherproof electrical connection guard of claim 1 further comprising an audible alarm to alert users of its location for safety.

13. The weatherproof electrical connection guard of claim 1 further comprising a visible alarm to alert users of its location for safety.

14. The weatherproof electrical connection guard of claim 1 further comprising a viewing window in the housing for viewing the interconnected plugs.

15. The weatherproof electrical connection guard of claim 1 further comprising an access door in the housing for providing access to the interconnected plugs.

16. The weatherproof electrical connection guard of claim 1 further comprising a moisture sensor within the interior compartment.

17. The weatherproof electrical connection guard of claim 16 further comprising an alarm activated by the moisture sensor.

18. A weatherproof electrical connection guard for protecting electrical cord plug connections, comprising:

an elongated tubular vertical housing having a closed top for providing protection from the weather and an open bottom for access to an interior compartment within the housing; the interior compartment adapted to receive through the open bottom a plurality of interconnected plugs of a plurality of pairs of electrical cords;

a curved slot extending from the open bottom and terminating in a catch sized to releasably secure a plurality of pairs of electrical extension cords and to prevent disconnection of the interconnected plugs when a pulling force is applied to any of the plurality of electrical cords; and a mount extending from the side of the open bottom for vertically mounting the connection guard in an elevated position above a surface, the mount positioned so as to not obstruct access to the interior compartment through the open bottom.

19. A weatherproof electrical connection guard for protecting electrical cord plug connections, comprising:

an elongated vertical tubular housing having a closed top for providing protection from the weather and an open bottom for access to an interior compartment within the housing; the interior compartment adapted to receive through the open bottom a plurality of interconnected plugs of a plurality of electrical cords;

means for releasably securing the plurality of electrical cords to prevent disconnection of the interconnected plugs when a pulling force is applied to any of the plurality of electrical cords, said means for releasably securing extending from the open bottom; and means for vertically mounting the connection guard in an elevated position above a surface extending from the open bottom and positioned so as to not obstruct access to the interior compartment through the open bottom.

* * * * *